United States Patent [19]

Wildman et al.

[11] 4,212,466

[45] Jul. 15, 1980

[54] GAME APPARATUS

[76] Inventors: John R. Wildman, North Riverside; Burton C. Meyer, Downers Grove, both of Ill.

[73] Assignee: Marvin Glass & Associates, Chicago, Ill.

[21] Appl. No.: 892,646

[22] Filed: Apr. 3, 1978

[51] Int. Cl.[3] ..... A63F 7/24; A63F 7/30

[52] U.S. Cl. ..... 273/121 R; 273/129 V; 273/129 W

[58] Field of Search ..... 273/121 R, 121 A, 129 HB, 273/122 R, 122 A, 129 HA, 119 R, 119 A, 120 R

[56] References Cited

U.S. PATENT DOCUMENTS

| | | | |
|---|---|---|---|
| 638,436 | 12/1899 | Bennett | 273/121 R |
| 2,164,361 | 7/1939 | Swenson | 273/121 R |
| 2,230,950 | 2/1941 | Hough | 273/121 R |
| 2,682,409 | 6/1954 | Irwin | 273/121 R X |
| 2,709,593 | 5/1955 | Burnside | 273/121 A |
| 2,921,792 | 1/1960 | Guss | 273/129 HB |
| 3,224,775 | 12/1965 | Ritz | 273/121 R |
| 3,884,472 | 5/1975 | Meyer | 273/121 R |

*Primary Examiner*—George J. Marlo

[57] ABSTRACT

A mechanical, pin-ball type game apparatus comprises an enclosure for holding one or more balls including a sloping bottom wall or game board with a peripheral side wall for containing the balls as they roll downwardly on the sloped game board towards a lower end portion thereof on a scoring pass. A manually operated ball firing device is provided for shooting or propelling the balls upwardly from the lower end portion of the board towards an upper end and the balls then roll downwardly on the board and engage target devices thereon. The game apparatus includes rows of ball actuated target devices including ball engaging paddles mounted on rotatable shafts. The targets include a spring motor which is released when hit to forceably propel the ball coming in contact therewith in an opposite direction. Each time the target device is activated by ball contact, a scoring device is advanced and a bell is sounded. The release mechanism is a downwardly deflectable pad mounted on the bottom wall. A stop member is provided to limit rotation of the shaft each time a ball rolls onto the deflectable release pad. A counter registers each time a ball rolls onto a release pad. Manually powered flippers are returned to the ready position by the use of rubber bands to provide a bias force.

17 Claims, 9 Drawing Figures

10
12
24
52
54
56
60
34
84
90
92
88
94
110
116
4
170
180
188
174
176
"C"
190
192
194
58
196
32a
86
198
200
16
202
204
"E"
82
80
38
32
22
28
36
20
18
158
156
154
40
14
208
210
44
42
46
168
18a
30
48
50
"A"
126
132
136
122
150
142
146
144
140
166
162
164
154a
152
148
120

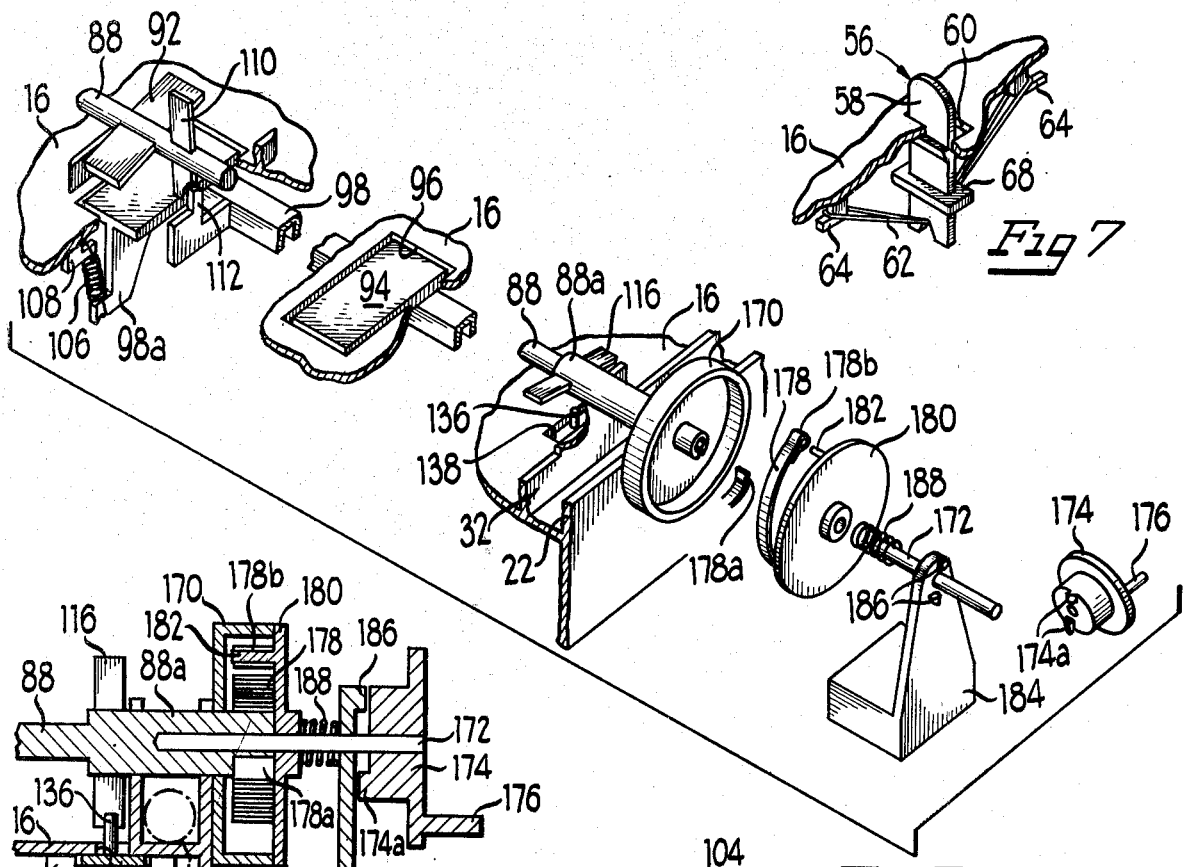
Fig 7
Fig 3
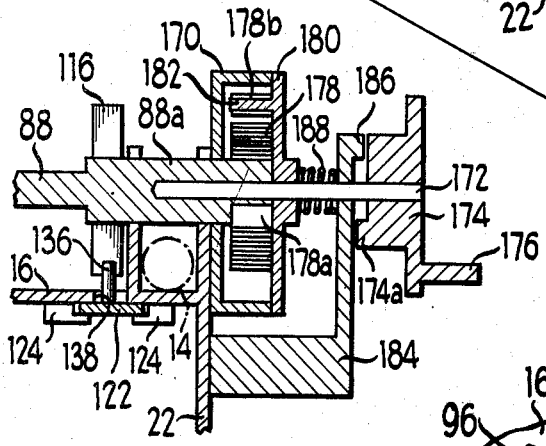
Fig 4
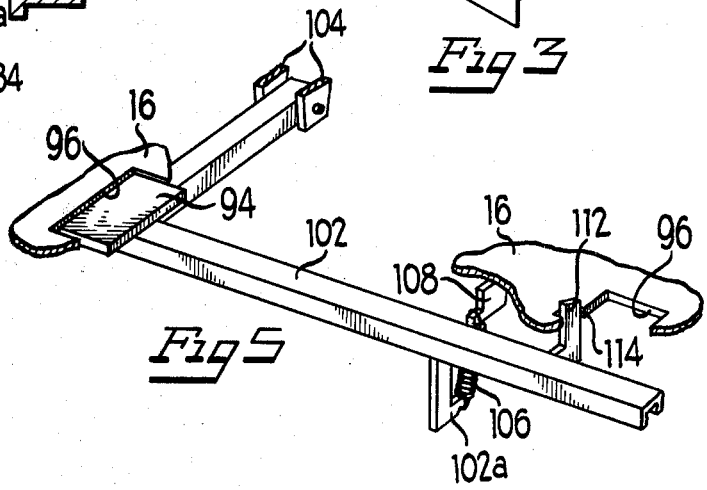
Fig 5
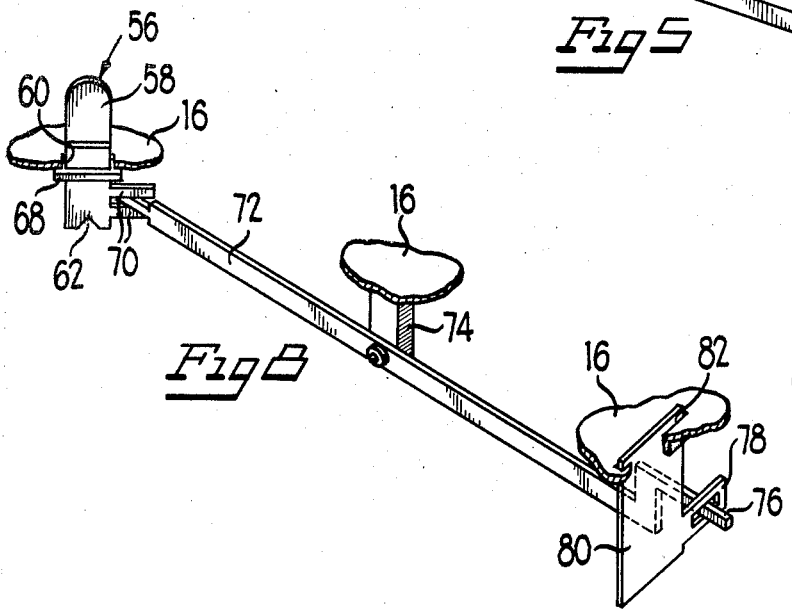
Fig 8
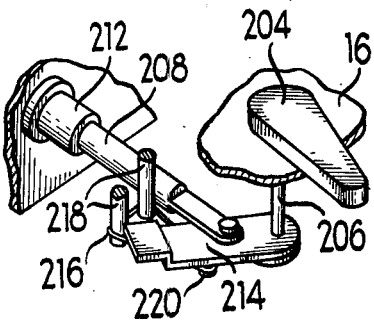
Fig 9

GAME APPARATUS

BACKGROUND OF THE INVENTION

1. Field of the Invention

The present invention relates to a new and improved game apparatus and more particularly to a pin-ball machine type game. The game is mechanically powered and does not require electricity from either an external power source or a battery to provide for operation of the action components. In play, the new game provides emphasis on manual skill and dexterity and provides exciting action for a player.

2. Description of the Prior Art

A wide variety of pin-ball type machines are extremely complex in nature, often including electronic scoring devices and electronic programming as well as electrically powered target devices for providing increased activity and action with the rolling balls. In addition, many pin-ball type games are coin activated and require considerable skill and dexterity of the players. These games often require electrical power sources internally or from external sources and are not very portable. Other pin-ball type games are more mechanical in nature and often utilize springs or battery powered electrical devices for facilitating and enhancing game activity. U.S. Pat. No. 2,582,290 illustrates a practice putting target wherein a plurality of paddles mounted on an overhead shaft are used for counting scores and a central electrically powered kick-back assembly is provided for returning putted golf balls to the putter when the golf balls are properly aimed and putted to contact a trigger on a target. Another practice putting device is shown in U.S. Pat. No. 3,467,389 wherein a golf ball is putted to contact a target and when accurately aimed, is forcefully kicked-back or returned to the putter. U.S. Pat. No. 702,088 and 1,784,068 illustrate other pin-ball type game apparatus or tables wherein rolling balls are directed towards a variety of different types of targets positioned on the game board. These games are adapted to provide scoring counts as the balls roll down a game board surface.

It is an object of the present invention to provide a new and improved game apparatus of the pin-ball type.

More particularly, it is an object to provide a new and improved pin-ball type game apparatus which does not require an electrical power source such as an external power system or an internal battery yet still provides an action type game with manual skill and dexterity aiding in gaining a higher score in a scoring system.

Another object of the present invention is to provide a new and improved game apparatus of the character described including a target system wherein the rolling balls are adapated to trigger or release a spring motor means for forcefully propelling the balls in a given direction.

Another object of the present invention is to provide a new and improved manually powered game apparatus which includes means for keeping a visual score. Another object is to provide a game apparatus of the manually operated type which provides an audible signal when particular targets are struck by the rolling balls.

Yet another object of the present invention is to provide a new and improved manually operated game apparatus wherein manually controlled and powered flippers are provided for forcefully directing the balls in a direction calculated to increase the scoring for the player.

Yet another object of the present invention is to provide a new and improved game apparatus having novel target means which provides for return of a free ball when a particular target element is contacted.

Still another object of the present invention is to provide a new and improved manually powered game apparatus of the character described wherein a rewindable spring motor means is provided and which motor means can accommodate several successive releases of spring energy before rewinding is required.

Yet another object of the invention is to provide a new and improved game apparatus of the character described which is portable, and which is fun to play with and relatively low in cost.

SUMMARY OF THE INVENTION

The foregoing and other objects and advantages of the present invention are accomplished in a new and improved manually powered and operated game apparatus of the pin-ball machine type wherein an enlarged enclosure is provided for holding one or more balls and includes a sloping bottom wall as a playing surface for rolling balls with a peripheral side wall for containing the balls as they roll downwardly towards a lower end portion on a scoring pass. A manually controlled firing mechanism is provided for propelling the balls upwardly toward the upper end portion of the enclosure and a plurality of targets are mounted in the enclosure on the playing surface which is adapted to be engaged or contacted by the balls rolling in a generally downwardly direction. These targets include a least one spring motor means which is releasable by ball contact for forcefully propelling the ball in a particular direction. Some of the targets are interconnected with a visual scoring device including number bearing index wheels and an audible signal such as a bell is activated by particular targets when struck by a rolling ball. In addition, the game apparatus may contain one or more manually actuated flippers or levers for propelling the balls upwardly as well as other targets which provide interesting action when engaged or contacted by a ball. The targets may include linkages for controlling a gate to provide for a free ball to return to the firing or propelling device so that the player receives an additional scoring chance.

BRIEF DESCRIPTION OF THE DRAWINGS

For a better understanding of the invention, reference should be had to the following detailed description taken in conjunction with the drawings, in which:

FIG. 3 is a fragmentary, perspective view with portions broken away and in section showing one of the target systems of the game apparatus;

FIG. 4 is a fragmentary, sectional view taken substantially along lines 4—4 of FIG. 1, illustrating a rewindable spring motor means of the target system of FIG. 3;

FIG. 5 is a fragmentary perspective view similar to FIG. 3 but illustrating another type of target system of the game apparatus;

FIG. 7 is a fragmentary, perspective view of another type of target element utilized in the game apparatus of the present invention;

FIG. 8 is a top, perspective view shown in section, with portions broken away illustrating yet another target system of the game apparatus of the present invention; and FIG. 9 is a fragmentary, top perspective view with portions broken away and in section illustrating one of the manually activated ball flipper systems of the game apparatus.

DESCRIPTION OF THE PREFERRED EMBODIMENT

Figures 1, 6:
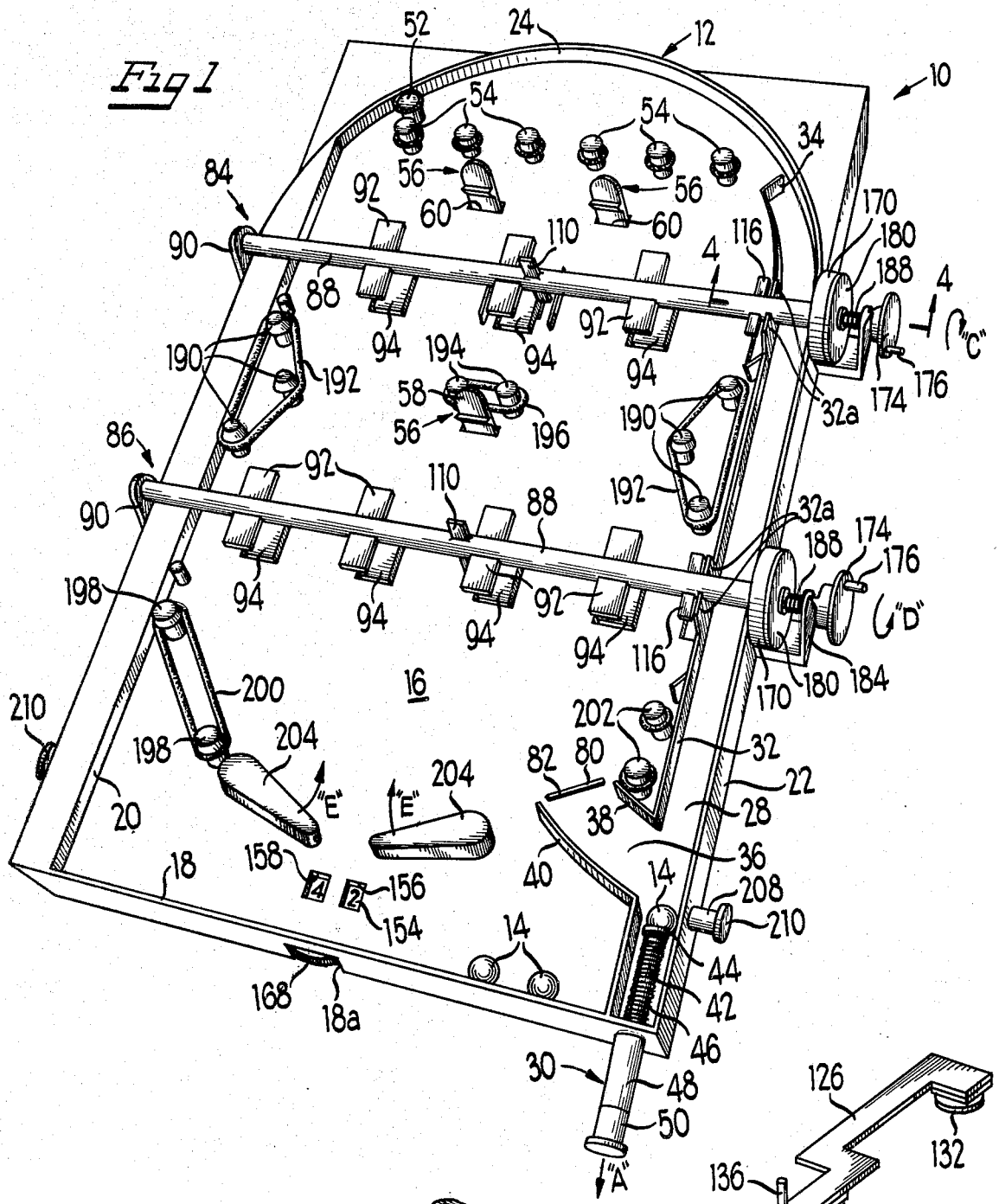
FIG. 1 is a top, perspective view of a new and improved pin-ball type game apparatus constructed in accordance with the features of the present invention.
FIG. 6 is a perspective view of a score counting system of the game apparatus illustrated with portions broken away and in section and shown as it is viewed from the underside of the game apparatus as in FIG. 2.

Referring now more particularly to the drawings, in FIG. 1 is illustrated a new and improved pin-ball type game apparatus constructed in accordance with the features of the present invention. The pin-ball game is referred to generally by the reference numeral 10 and includes a relatively large enclosure 12 for containing one or more spherical balls 14 which are used to play the game. The enclosure 12 includes a relatively large, rectangular, flat bottom wall or playing surface 16 and an upstanding peripheral wall including a lower end wall 18, a left hand side wall structure 20, a right hand side wall 22 and a curved upper end wall 24 adapted to guide upwardly moving balls 14 into a downward rolling path over the surface of the bottom wall.

Figure 2:
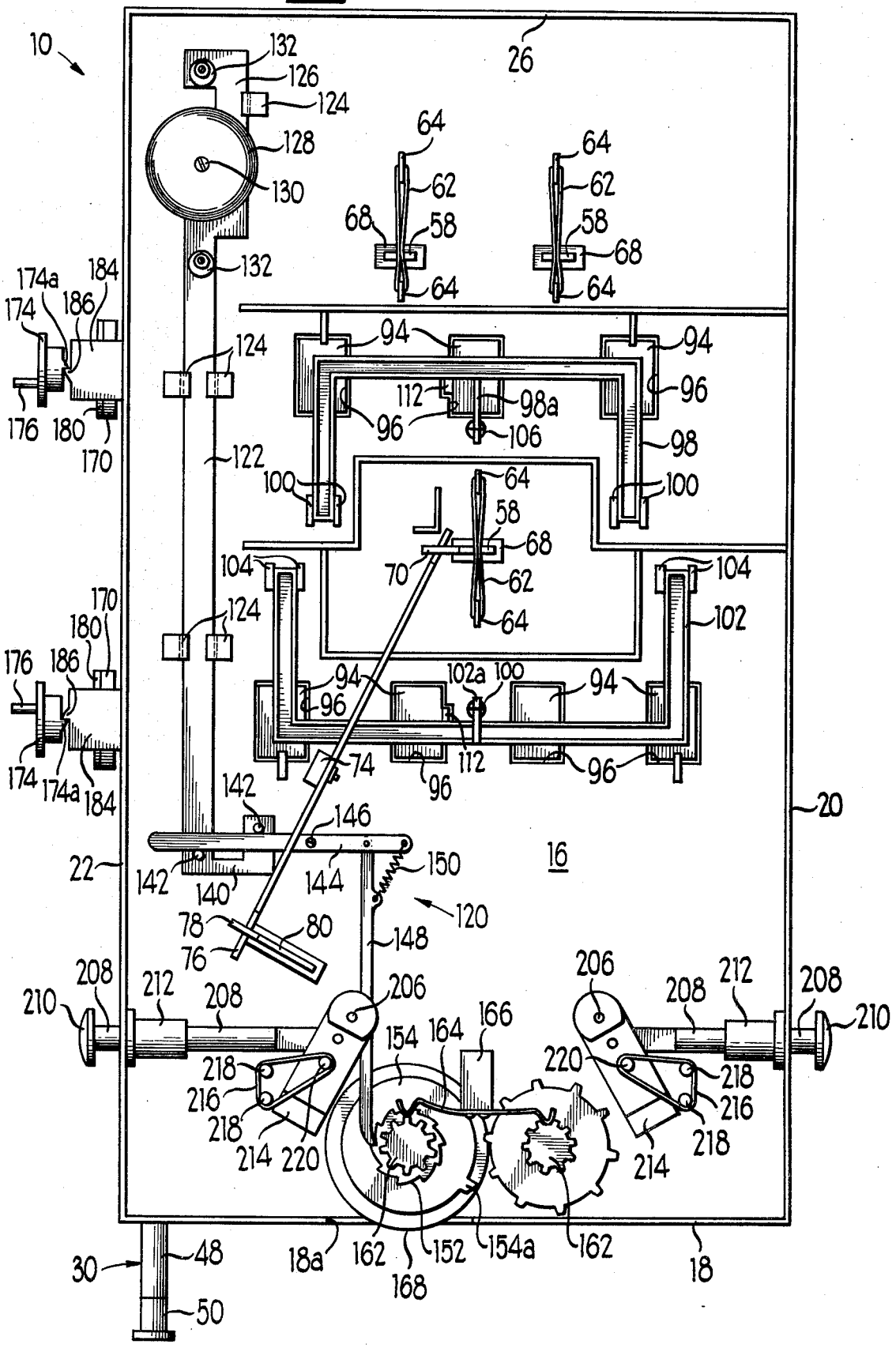
FIG. 2 is an underside view of the game apparatus of FIG. 1.

As indicated in FIG. 2, the lower end wall 18 and side walls 20 and 22 are integrally formed with the bottom wall 16 and extend downwardly below the underside of the bottom wall to provide strength and support for the whole enclosure structure. In addition, at the upper end of the enclosure, a downwardly depending wall 26 is provided to complete a rectangular stiffening frame work below the bottom wall. Preferably, the enclosure 12 is formed of light weight, strong, molded plastic material and the game is readily portable to any desired playing location.

Along the right hand side wall 22 a firing alley or passage 28 is provided for the balls 14 which are manually fired upwardly by a spring powered propelling or firing mechanism 30 at the lower right hand corner of the game board enclosure. The firing alley is formed by an inside wall or fence 32 spaced inwardly and parallel of the right hand side wall 22 and at the upper end, the fence is provided with a deflectable spring gate 34 which permits balls to pass upwardly into the upper end portion of the enclosure adjacent the curved end wall 24 but prevents their return back down the firing alley 28. At the lower end, immediately forward of the firing mechanism 30, the inside alley wall is interrupted to provide a return ball passage indicated by the reference numeral 36 and formed by a pair of spaced apart walls 38 and 40 integrally joined with the alley wall 32 and curving upwardly and laterally inwardly therefrom.

The firing device includes an elongated plunger 42 having a cushion or head 44 at the upper end for engaging contact with the balls and the plunger is biased upwardly by an axially aligned coil spring 46 positioned between the plunger head and the lower end wall 18 of the game board enclosure. The lower end portion of the plunger 42 is slideable within a hollow supporting sleeve 48 projecting outwardly of and integral with the lower end wall 18 and a knob 50 is provided at the outer end of the plunger for manually grasping the plunger when compressing the spring 46 in order to shoot or fire a ball up the alley 28 into play. With a ball in position in contact with the plunger head 44, the knob 50 is retracted as indicated by the arrow "A" in FIG. 1 until the desired amount of compression on the spring 46 is achieved and then the knob 50 is released so that the spring biases the plunger head upwardly to propel the ball upwardly through the alley 28 at the desired speed. The ball speed is dependent upon the skill of the player, who selects the desired amount of compression on the spring 46 at the time of release of the plunger, so that the ball will be shot or fired upwardly past the spring gate 34 into the upper end portion of the game board enclosure as desired. The ball then rolls downwardly on a tortuous path over the bottom wall 16 to provide the action associated with pin-ball type games. The balls roll downwardly over the bottom wall or playing surface 16 at a rate dependent upon the slope of the bottom wall and the number of target devices encountered and contacted by the balls. After a ball has completed a scoring pass, to comes to rest against the lower end wall 18 as shown, unless the ball passes into the free-shot passage 36 between the walls 38 and 40 and in this instance, the player is entitled to a second shot with the same ball.

In accordance with the present invention, the pin-ball game includes an upper stop or pumper post 52 having a resilient annular ring and this bumper post is positioned adjacent the curved end wall 24 at the left hand side in order to intercept and rebound the balls rolling in contact around the curved upper end wall. Immediately below the bumper post 52 there is provided a plurality of similar bumper posts 54, positioned at spaced intervals in a row or line transversely across the upper portion of the game board surface. The posts are spaced widely so that the balls can pass between adjacent bumper posts in the line and each post includes a resilient ring for reloading the balls. Below the row of bumper posts 54, there is provided a pair of upstanding flat target elements 56 positioned on opposite sides of the center line of the game board enclosure. Referring to FIGS. 1 and 7, each target element 56 includes an upstanding blade 58 of thin, flat, plastic material extending upwardly through an enlarged rectangular opening 60 formed in the bottom wall 16. As indicated in FIG. 7, the post or blade is rounded at its upper end and is provided with a V-shaped notch at the lower end. The target blade is biased upwardly in the rectangular opening 60 by means of a rubber band 62 which is tensioned between a pair of integrally formed hook-like projections 64 provided on the underside of the bottom wall 16. As indicated in FIG. 7, the rectangular opening 60 is considerably wider than the thickness of the target blade 58 and the blade is formed with an integral ridge or stop 66 on one side intermediate the ends. The stop normally engages a lower edge of the recess in the bottom wall and this engagement prevents the rubber band 62 from biasing the blade further upwardly. Spaced below the stop 66, the blade 58 is provided with a relatively large annulus or ridge 68 and this ridge is larger than the opening 60 in order to positively limit the upward travel of the blade relative to the bottom wall 16. When the stop ridge 66 is moved out of engagement with an edge surface of the rectangular slot 60 by a rolling ball 14 striking the downwardly facing side of the blade, this causes the blade to rock or pivot upwardly (arrow "B") and the rubber band 62 is then free to rapidly snap the blade element upwardly in the slot until the lower stop surface 68 engages the underside of the bottom wall 16 and limits further upward travel. The blades 58 are movable between a lower or cocked position and an upper or release position, and the movement is rapid with a snapping sound. The blade element 58 is manually reset by pushing the upper end downwardly and re-engaging the upper surface of the stop ridge 66 against the lower, underside edge surface of the rectangular slot 60 in the bottom wall 16. If a ball strikes the upward facing surface of the blade 58, it may also cause the element to pivot or rebound and then snap into the upper or released position.

Referring now to FIG. 8, the game apparatus includes another single target element 56 positioned adjacent the center line of the bottom wall surface 16 in another rectangular opening 60. This single target element operates in the same manner as the upper pair of target element 56. The lower blade 58 is formed with a pair of vertically spaced apart, laterally extending arms 70 on one edge, and these arms engage the upper end of a trip lever 72 which is pivotally mounted intermediate its ends on an integral, depending bracket 74 formed on the underside of the bottom wall 16. At the lower end, the lever 72 is provided with a finger 76 which projects into a slotted arm 78 on the lower end of a gate 80 mounted in a thin, rectangular slot or opening 82 in the bottom wall positioned at the upper end or mouth of the ball return passage 36 between the walls 38 and 40. As illustrated in FIG. 8, when a ball strikes the downwardly facing side of the single lower target element 56 causing the element to snap into the upper or released position, the lever 72 is pivoted to move the gate 80 out of an upwardly projecting or gate closed position wherein the entrance to the return passage 36 is blocked into a downward or retracted, open position which permits the balls to roll into the return passage for a free shot. Manual resetting of the center target element 56 moves the gate 80 to the closed position.

In accordance with the present invention, the game apparatus 10 includes a pair of upper and lower action target assemblies 84 and 86 spaced above and below the single central target elements 56 as shown in FIG. 1. The upper and lower target assemblies are similar in structure and operation except that the upper target assembly when released causes the balls to be forcefully propelled in a generally downward direction and the lower target assembly 86 causes the balls to be propelled in a generally upward direction. Each target assembly includes an elongated shaft 88 supported at the left hand end on an upstanding shaft bearing bracket 90 attached to the side wall structure 20 of the enclosure. At the right hand end portion, each shaft is supported on upstanding bracket portion **32*a* formed on the inside of the alley wall 32. The shafts 88 are rotatable in their supporting brackets and are spaced above the upper surface of the bottom wall 16 by a sufficient distance so that the balls 14 may freely pass below the shafts without interference. At spaced intervals, the shafts are provided with diametrically positioned paddles or rackets 92 for forcefully striking the balls to forcefully propel the balls upwardly or downwardly over the game board surface when the shaft is released to rotate. The paddles 92 are dimensioned so that their outer ends will clear the upper surface of the game board bottom wall 16 and when a rotating paddle strikes a ball 14, the ball is rapidly propelled or fired in a downward direction in the case of the upper target assembly 84 or in an upward direction in the case of the lower target assembly 86**.

The upper target assembly shaft 88 is provided with three longitudinally spaced paddles 92 while the lower shaft 88 is provided with four, however, different numbers of paddles could be selected as desired. Beneath each of the paddles or rackets 92, a release pad or trigger 94 is mounted in a rectangular opening or slot 96 formed in the bottom wall 16. Referring to FIGS. 2, 3 and 5, the release pads 94 of the upper target assembly 84 are supported on a bight portion of a U-shaped bracket 98 having outer ends of its legs pivotally secured to downwardly depending brackets 100 on the under side of the bottom wall 16. Similarly, the release pads or triggers 94 of the lower target assembly 86 are supported on the bight portion of a U-shaped member 102 having its legs pivotally interconnected to depending brackets 104 formed on the underside of the bottom wall 16.

As illustrated in FIG. 2, the legs of the upper, U-shaped member 98 extends downwardly towards the pivot brackets 100 and the legs of the lower, U-shaped support 102 extend upwardly toward the pivotal mounting brackets 104. In either case when the balls 14 roll over the upper surface of the pads 94, the bight portions of the U-shaped supports are depressed downwardly away from the underside of the bottom wall 16. Normally, the bight portion of the brackets is biased upwardly so that the release pads or triggers 94 are slightly above or flush with the upper surface of the bottom wall 16 and for this purpose, the U-shaped supports are provided with a finger **98*a* and 102*a*, respectively, at a mid point which are biased upwardly toward the bottom wall by means of a bias spring 106 having its upper end hooked to a finger on a hook-like projection 108 integrally formed on the underside of the bottom wall. Accordingly, when the bight portion of the support member is deflected downwardly by the presence of a ball on one of the trigger or release pads 94, the target assembly is activated and the shafts 88 are permitted to rotate one half turn or 180°. The paddles 92 are generally at rest in a horizontal position above and parallel to the upper surface of the bottom wall 16 and when they rotate with the shaft the outer ends pass closely above the pads to engage the balls forcefully to propel or shoot the ball away from the pad. Once the ball is moved off of a release pad, the bias springs 106** are effective to return the release pads to the normal flush or non-depressed position.

In order to limit shaft rotation to one half turn, each time a trigger pad is depressed, the shafts 88 are provided with diametrically extending stop members 110. The outer ends of these members are adapted to normally engage an upwardly extending release finger 112 attached to the bight portion of the respective U-shaped supports 98 and 102. The upper end portion of the release fingers 112 extend through small rectangular openings 114 (FIG. 5) formed in the bottom wall 16 and when the bight portion of the U-supports are depressed by the presence of a ball on a release pad 94, the fingers 112 are moved downwardly out of engagement with the outer end portion of the stop members 110 to a releasing position permitting the shaft to rotate 180° approximately, until the opposite end portions of the stop member again engages the release finger which is now returned to its upper or normal holding position after the ball 14 is forcefully ejected from the release pad.

The diametrical stop members 110 are positioned to extend at right angles with respect to the brackets or paddles 92 on the shaft 88 and these stop members generally remain in the position shown in FIG. 1, normal to the upper surface of the bottom wall 16 until a ball rolls onto a release pad and effects the release of the shaft to rotate one half of a turn.

Each target assembly 84 and 86 is provided with a counting finger 116 at the right hand end and these counting fingers are similar to the stop members 11 but are positioned at 90° thereto and parallel of the rackets or paddles 92 as illustrated. Each time the shaft is triggered to rotate 180°, the outer end of a counting finger 116 sweeps in an arc in close proximity to the upper surface of the enclosure bottom wall 16. The counting fingers 116 are adapted to operatively engage a counting and scoring mechanism generally indicated by 120 and best shown in FIGS. 2 and 6 each time either shaft 88 is released to rotate a half turn. The scoring and counting assembly includes an elongated arm 122 mounted for sliding movement in pairs of slide guides 124 formed on the underside of the bottom wall 16. As best shown in FIG. 6, at the upper end, the elongated arm 122 is formed into a C-shape portion 126, in order to accommodate a bell 128 which is secured to the underside of the bottom wall 16 on a suitable fastener pin 130. Adjacent the C-shaped portion 126, there is provided a pair of spaced apart clappers 132 mounted on the arm to engage opposite sides and ring the bell as the arm is reciprocated up and down. At spaced intervals on the arm 122 adjacent the respective target assemblies 84 and 86, there are provided upstanding pins 136 which are slideable within slots 138 formed in the bottom wall 16 adjacent the alley wall 32 as best shown in FIGS. 3 and 4. Each time one of the paddle shafts 88 is released to rotate one half turn, the counting fingers 116 engage the upper end portion of the pins 136 causing the arm 122 to slide upwardly or downwardly in the guides until the upper or lower clapper 132 engages and rings the bell 128. Adjacent the lower end, the arm element 122 is formed with a C-shaped portion 140 extending laterally outwardly at right angles with a pair of pins 142 extending downwardly thereof and engaging opposite longitudinal edges of a lever 144 which is secured to a pivot pin 146 projecting downwardly from the bottom wall 16. The lever 144 extends inwardly towards the central portion of the bottom wall and a pawl 148 is pivotally secured to the end of the lever and extends generally downwardly at right angles. A bias spring 150 is interconnected between the pawl and the lever causing the lower end of the pawl to remain in engagment with the toothed surface of a ratchet wheel 152. The ratchet wheel is adapted to rotate a larger, "units" counting wheel 154 having numerical digits 0 through 9 on the upper surface which may be viewed through a "units" window 156 formed in the bottom wall 16 of the enclosure at the lower end. A "tens" window 158 is also provided adjacent the unit window and this window displays the numbers 0 through 9 on the upper face of a "tens" wheel mounted to rotate adjacent the underside of the bottom wall 16. Each time the elongated counting arm 122 is moved upwardly or downwardly, by either target mechanism 84 or 86 the lower end of the pawl 148 advances the ratchet wheel 152 and one tenth of a revolution causes the "units" display wheel 154 to rotate until the next digit is displayed in the "units" window. The "unit" wheel and the "ten" wheel are mounted for rotation on suitable shafts (not shown) on the underside of the bottom wall 16 and the unit wheel includes a single tooth 154a adapted to engage and advance the "tens" wheel on a ratio of one to ten. The wheels are maintained in correctly indexed relation by means of toothed detent wheels 162 which are engaged by detent portions at opposite ends of a detent spring 164 secured on a mounting block 166 on the underside of the bottom wall.

In order to reset the visual display counter including the "units" wheels and the "tens" wheel, there is provided a thumb wheel 168 having a serrated circumferential edge having a portion which projects outwardly through a slotted opening **18*a* in the outer end wall 18. After a game has been played, the thumb wheel 168** is rotated to return the counting wheels to zero for starting of the next game.

Referring now to FIGS. 3 and 4, the shafts 88 of the respective upper and lower target assemblies 84 and 86 are provided with enlarged right hand end portions **88*a* having a hollow, generally cylindrical drum 170 mounted on an outer end portion outwardly of the side wall 22. The enlarged segment of the shaft is formed with a hollow, axial bore open at the outer end in order to receive a shaft 172 for supporting a winding wheel 174 having an eccentric crank pin 176. The crank is adapted to be grasped by the fingers for turning the winding wheel. A spring motor 178 is mounted in the drum 170 and an inner end 178*a* thereof, is seated in a radial slot provided in a central hub portion on the enlarged shaft section 88*a*. A closure disk 180 having an eccentric pin 182 is secured to the shaft 172 and a looped outer end of the spring 178*b* is mounted on the pin 182 so that when the winding wheel 174 is turned, the spring is wound up around the shaft portion 88*a* within the cylindrical drum 170. The wound up spring provides a reservoir of stored energy for turning the shaft 88** when released in a series of subsequent controlled half revolutions triggered when a ball passes onto one of the release pads as previously described.

The spring motor 178 provides rotative power for driving the shaft 88 on a number of successive half turn cycles without requiring rewinding and the winding wheel 174 thus needs to be rewound only periodically during prolonged play with the game apparatus. The outer end portion of the winding shaft 172 is supported in an upstanding leg of an L-shaped bracket 184 attached to the outer surface of the right hand wall 22 as best shown in FIGS. 3 and 4. The outside face of the upper leg of the brackets is formed with angularly spaced latching cams 186 spaced around the shaft opening and these latching cams cooperate with cams **174*a* formed on the inside annular face of the winding wheel. Engagement between the cams retains the winding tension on the spring 178 and the cams are biased into latching engagement by means of an axial coil spring 188 mounted on the winding shaft 172 between the winding disk 180 and the inside surface of the upper leg of the L-bracket 184**.

As illustrated in FIG. 1, the spring motor 178 of the upper target assembly 84 is wound up or tightened by turning the winding wheel 174 in a clockwise direction as shown by the arrow "C" whereas on the lower target assembly 86, the winding wheel 174 is used to tighten the spring motor 178 by turning the crank in a counterclockwise direction as indicated by the arrow "D." When a ball rolls onto a release pad or trigger 94 of the upper target assembly 84, the tension of the spring motor is released to rotate the shaft 88 for one half a revolution in a clockwise direction and as indicated by the arrow "C'" and this causes ball 14 on the target to be propelled sharply downwardly by the rotating paddle 92. The amount of propelling force is determined by the amount of tension remaining on the wound spring where it is released. Similarly, when a ball rolls onto a pad 94 of the lower target assembly 86, the shaft 88 is released to rotate one half turn in a counterclockwise direction as indicated by the arrow "D" and this causes the paddles 92 to propell the ball upwardly towards the upper end of the game board enclosure 12. Each time the shaft 88 of one of the target assemblies is released to rotate one half turn, the spring motor or the target assembly winds down a bit, however, enough energy may be stored in a single winding so that the spring motor is capable of providing a relatively large number of half turn rotations before rewinding is necessary. The target assemblies 84 and 86 are mechanically powered and require no electrical motors, solenoids, batteries or the like. In addition, the rotating paddles 92 provide exciting action and cause the scoring system 120 to register scores both of visually and audibly each time a paddle is released.

Referring to FIG. 1, the game apparatus 10 is also provided with groups of triangular spaced bumping posts 190 adjacent opposite side walls 20 and 32 as illustrated and a rubber band or other elongated core 192 is provided on the posts to rebound action. In the center of the enclosure, between the upper and lower target assemblies 84 and 86 there is provided a pair of bumping posts 194 and an elastic band 196 is entrained around these two bumping posts to provide rebound action. Below the lower target assembly 86, the game apparatus includes another pair of bumping posts 198 with an elastic band 200 looped around these posts and individual bumping posts 202 are provided on an opposite side portion of the game apparatus. The bumpiang post 52, 54, 190, 194, 198 and 202 are identical in construction and provide rebounding surfaces in conjunction with elastic bands 192, 196 and 200 to generate increase action for the players of the game.

In accordance with the present invention, the game apparatus 10 also includes a pair of manually powered flippers 204 mounted adjacent the lower end portion of the enclosure 12 on shafts 206 (FIG. 9) which extend downwardly through suitable bosses provided in the bottom wall 16. As illustrated in FIG. 1, the flippers are generally triangular shape and are pivoted adjacent their outer ends so that their inner ends will move upwardly as indicated by the arrows "E" when the flippers are activated by the player. Each flipper is controlled with a push rod 208 having an enlarged outer end 210 and the rods are seated for longitudinal sliding movement in bearing sleeves 212 attached to the inside surface of the side walls 20 and 22 below the bottom wall 16. The inner ends of the push rods 208 are pivotally connected to lever arms 214 attached to the lower ends of the flipper shafts 206 and these lever arms are driven to rotate by inward pressure on the manual push rods 208. After the pressure is removed, the push rods are rapidly returned outwardly to the ready position by a resilient bias force provided by rubber bands 216. The rubber bands are looped around a pair of fixed stop members 218 depending from the underside of the bottom wall 16 and a pin 220 mounted on the lever arm 214. As indicated, when the player depresses the push rods 208 inwardly from either the left hand or right hand side of the game enclosure, the respective flippers 204 are rapidly rotated from the rest position of FIG. 1 to pivot in the direction of the arrows "E" and if a ball is contacted it is moved rapidly upwardly depending upon the point of contact and the amount of force the player provides. After the pressure on the push rods is released, the rubber bands 216 which are readily replaceable should they become broken, cause the flippers to rapidly return to the original position ready for the next action.

From the foregoing it will be seen that the game apparatus of the present invention is mechanically powered, manually controllable, and requires no electronic programs, electric power sources and the like, yet the game provides interesting action and requires skill and manual dexterity on the part of the players. The game 10 is readily portable and can provide hours of amusement for children and adults.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A game apparatus comprising:

an enclosure for holding one or more balls including a sloping bottom wall and a peripheral side wall for containing said balls as they roll on said bottom wall toward a lower end portion thereof;

manually controlled means for launching said balls from said lower end portion toward an upper end portion;

target means in said enclosure adapted to be engaged by a ball rolling on said bottom wall, said target means including a releasable drive means;

a release member activated by contact with said ball for actuating said drive means; and a paddle mounted on a shaft for rotation therewith, said drive means including a biasing member on said shaft to rotate the same in response to activation thereof, to forcefully propel said ball in a given direction.

2. The game apparatus of claim 1 including manual winding means for tensioning said biasing element.

3. The game apparatus of claim 1 wherein said target means includes stop means for limiting the amount of rotation of said shaft when said release means is activated.

4. The game apparatus of claim 1 wherein said release member includes a pad mounted in an opening in said bottom and biased toward a first position even with said bottom wall and deflectable downwardly toward a release position when a ball rolls onto the surface thereof.

5. The game apparatus of claim 4 including stop means for limiting the amount of rotation of said shaft and paddle each time a ball rolls onto said release pad.

6. The game apparatus of claim 5 including manual means for winding said biasing element to store spring energy for a plurality of successive cycles of rotation of said paddle means.

7. The game apparatus of claim 5 wherein said shaft is positioned above said balls rolling on said bottom wall, and said stop means comprising an arm on said shaft and a latch element normally engaging said arm and deflectable out of engagement when said pad is deflected downwardly by a ball rolling onto the surface thereof.

8. The game apparatus of claim 7 wherein said arm extends radially outwardly in opposite directions from said shaft and said paddle extends radially outwardly of said shaft in opposite directions, said arm and said paddle being spaced apart longitudinally on said shaft and at right angles to each other thereon.

9. The game apparatus of claim 4 including counter means for registering each time a ball rolls onto a release pad.

10. The game apparatus of claim 4 including bell means interconnected with said target means to ring each time a ball rolls onto said release pad.

11. A game apparatus of claim 1 including a plurality of paddles at spaced intervals on said shaft and a release pad for each of said paddles, at spaced apart positions in said bottom wall.

12. The game apparatus of claim 1 including a target element mounted in a generally upright position extending through an opening in said bottom wall with an upper portion in the path of said balls, said element including stop means intermediate its ends normally engaging said bottom wall, for retaining said element in a lower position, biasing means for urging said element upwardly in said opening and holding said element generally upright, said upper end portion being deflectable on contact with a ball moving said stop means free of engagement with said bottom wall whereby said biasing means is effective to move said element into an upper position.

13. The game apparatus of claim 12 in combination with a gate movable between open and closed positions for returning balls to said launching means and linkage means interconnecting said target element and said gate for opening the gate when said target element is moved into said upper position.

14. The game apparatus of claim 12 wherein said biasing means includes an elongated elastic member attached at opposite ends to said bottom wall and engaging a lower end of said target element intermediate said opposite end urging said element upwardly.

15. The game apparatus of claim 1 including a flipper mounted for pivotal movement on said bottom, push rod means mounted for lateral movement on a side portion of said peripheral wall for manually controlling the pivotal movement of said slipper, and means biasing said flipper toward a rest position when inward pressure on said push rod is released.

16. The game apparatus of claim 15 including a pivotally mounted lever interconnected for pivoting said flipper, said push rod pivotally interconnected to said lever outwardly of said pivotal mounting, said biasing means including a resilient member connected to said lever outwardly of said pivotal mounting.

17. The game apparatus of claim 16 wherein said biasing means includes a rubber band interconnected to said lever outwardly of said pivotal interconnection of said push rod means.

* * * * *